US007775847B2

(12) United States Patent
Matsubara et al.

(10) Patent No.: US 7,775,847 B2
(45) Date of Patent: Aug. 17, 2010

(54) METHOD FOR MANUFACTURING HOT CATHODE FLUORESCENT LAMP

(75) Inventors: Naoyuki Matsubara, Tokyo (JP); Masayuki Kanechika, Tokyo (JP); Yoshifumi Takao, Tokyo (JP); Kazuhiro Miyamoto, Tokyo (JP); Toshiyuki Nagahara, Tokyo (JP); Junji Matsuda, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 544 days.

(21) Appl. No.: 11/855,485

(22) Filed: Sep. 14, 2007

(65) Prior Publication Data

US 2008/0070467 A1 Mar. 20, 2008

(30) Foreign Application Priority Data

Sep. 14, 2006 (JP) ..... 2006-249597

(51) Int. Cl.
*H01J 9/00* (2006.01)
*H01J 9/24* (2006.01)
*H05B 33/10* (2006.01)

(52) U.S. Cl. ..... 445/26; 445/29

(58) Field of Classification Search ..... 445/26, 445/29

See application file for complete search history.

(56) References Cited

U.S. PATENT DOCUMENTS 4,272,702 A * 6/1981 Teshima et al. ..... 313/493
6,890,235 B2 * 5/2005 Lee ..... 445/22
6,988,923 B2 * 1/2006 Kobayashi et al. ..... 445/27

FOREIGN PATENT DOCUMENTS

JP 6-349448 12/1994

* cited by examiner

*Primary Examiner*—Toan Ton
*Assistant Examiner*—Britt D Hanley
(74) *Attorney, Agent, or Firm*—Kenealy Vaidya LLP

(57) ABSTRACT

A method for manufacturing a hot cathode fluorescent lamp can ensure or facilitate stable initial luminous intensity and provide improved product life characteristics even when the hot cathode fluorescent lamp employs a glass tube with an outer diameter of less than 7 mmϕ. One end of a glass tube can be sealed with a glass bead of a mount structure. The other opening end of the glass tube can be welded with an opening end of an exhaust pipe with bent portions of lead wires being sandwiched between the opening ends of the glass tube and the exhaust pipe. After evacuating a vacuum system that is constituted by the inner spaces of the glass tube and the exhausted pipe communicating with each other, the bent portions of the lead wires which extrude outside the vacuum system can be clamp-connected to power source lines extending from an external power source. The emitter of the filaments can be activated by the generated heat of the filament. After supplying mercury and a rare gas into the glass tube, the glass bead can be sealed, and unnecessary portions of the glass tube, the exhaust pipe, and the lead wires can be removed to complete the hot cathode fluorescent lamp, in accordance with one aspect of the disclosed subject matter.

19 Claims, 3 Drawing Sheets

METHOD FOR MANUFACTURING HOT CATHODE FLUORESCENT LAMP

This application claims the priority benefit under 35 U.S.C. §119 of Japanese Patent Application No. 2006-249597 filed on Sep. 14, 2006, which is hereby incorporated in its entirety by reference.

BACKGROUND

1. Technical Field

The presently disclosed subject matter relates to a method for manufacturing a hot cathode fluorescent lamp.

2. Description of the Related Art

Hot cathode fluorescent lamps have a filament coated with an emissive material (being a so-called "emitter") in the form of carbonate. If such a filament is supplied with a current while under vacuum, heat energy is generated at the filament, thereby changing the emitter that is in the form of carbonate into the corresponding metal oxide (being activated) to exhibit an electron emission characteristic.

One conventional exemplary configuration of such a hot cathode fluorescent lamp is shown in FIG. 1. The hot cathode fluorescent lamp has mounts 54 and a glass bulb 55. The mount 54 is formed of a flare stem 52 and an exhaust pipe 53. The flare stem 52 seals a pair of lead wires 51 thereinside, and the lead wires 51 are connected to a filament coil 50. The mount 54 configured as described above is disposed in an end region of the glass bulb 55 using the flare stem 52. The inside of the glass bulb 55 is vacuumed through the exhaust pipe 53, and thereafter, the filament coil 50 is supplied with a current through the lead wires 51 to activate an emitter coated on the filament coil 50.

Such a conventional hot cathode fluorescent lamp should have an insulating coating on the lead wires 51 that extend from the flare stem 52 to the vicinity of the filament coil 50. This insulating coating can restrict the injection of electrons into the lead wires 51 located at a position which is opposite to the discharge passage. This restriction can reduce the electrode fall voltage and can suppress the voltage drop. In addition to this, it is possible to improve its luminous efficiency.

In some other hot cathode fluorescent lamps, the same effects can be given by using a bead stem instead of such a flare stem 52 (see, for example, Japanese Patent Application Laid-Open No. Hei 06-349448).

In the hot cathode fluorescent lamp configured as described above, the flare stem 52 seals the lead wires 51 and the exhaust pipe 53 therein. The lead wires are disposed substantially parallel with each other in the longitudinal direction of the glass bulb 55. It should be noted that the exhaust pipe 53 extends from the inside of the glass bulb 55 to the outside of the glass bulb 55. In addition to this, the lead wires 51 are connected to the filament coil 50 disposed in the end region of the glass bulb 55 and extend to the outside of the glass bulb 55.

In this instance, if the outer diameter of the glass bulb 55 is 7 mmϕ, the outer diameter of the exhaust pipe 53 should be 2 mmϕ (i.e., a very thin pipe), which is the minimum limit for fabrication, due to the positional relationship between the lead wires 51 and the exhaust pipe 53. Since the flare stem 52 must be formed by flame processing, it is difficult to use a larger-sized flare stem to ensure the dimensional accuracy. Therefore, the miniaturization of such a flare stem is limited. Accordingly, if the flare stem 52 is used for the mount 54, the outer diameter of the glass bulb 55, to which the flare stem 52 is to be attached, must be approximately 7 mmϕ or greater. In other words, if a fluorescent lamp employs a glass bulb 55 with the diameter of less than approximately 7 mmϕ, such a fluorescent lamp cannot employ a mount using the flare stem 52.

On the other hand, if a bead stem is used for the mount 54, one side of the glass bulb where the mount is located is utilized as an exhaust pipe section. In this instance, the lead wires are connected to the filament coil at respective ends and are positioned within the exhaust pipe section at respective other ends. In other words, the lead wires are positioned within the vacuum system to be in vacuum.

After the inside of the glass bulb is evacuated, the filament coil supported within the glass bulb is supplied with a current to activate the emitter coated on the filament coil. In order to connect the lead wires located inside the glass bulb with an external power source line, a clamp section to connect them should be provided inside the exhaust pipe. Accordingly, the clamp section should have an air discharge function as well as a chucking function for supplying a current. In order to achieve both of these functions, the clamp section is required to have an accurate and complex structure for keeping air-tightness.

Furthermore, suppose that the lead wires are connected to the filament coil at respective ends and protrude from the end of the exhaust pipe section of the vacuum system at respective other ends. In this case, if the outer diameter of the exhaust pipe section (glass bulb) is less than approximately 7 mmϕ, the outer diameter of the lead wires should be 0.3 mmϕ or less, which is very thin in this type of lead wire. Accordingly, if the lead wires extend over a long distance, the wires may sag and/or bend undesirably, resulting in possible contact with each other or other problems.

Furthermore, if the diameter of the glass bulb is made smaller, the filament coil would be closer to the inner wall of the glass bulb. In this case, only with the bead stem, it is difficult to secure a certain gap between the filament coil and the inner wall of the glass bulb with high accuracy. In an extreme case, it would be conceivable that the filament coil is brought into contact with the inner wall of the glass bulb. If the filament coil comes into contact with the inner wall of the glass bulb, the heat generated at the filament coil may transfer to the glass bulb, resulting in a deterioration of the stable activation of the emitter. This may lead to unstable luminous intensity at the time of turning on. Furthermore, this may undesirably affect the product life characteristics of the hot cathode fluorescent lamp itself.

SUMMARY

The presently disclosed subject matter has been developed in view of the foregoing features, problems, and characteristics associated with conventional technologies. A method for manufacturing a hot cathode fluorescent lamp is disclosed which attempts to ensure the stable initial luminous intensity and provide improved product life characteristics even if the hot cathode fluorescent lamp employs a glass tube with a smaller outer diameter. The presently disclosed subject matter also relates to a method for manufacturing a hot cathode fluorescent lamp with good productivity and with good reproduction stability.

One aspect of the presently disclosed subject matter is a method for manufacturing a hot cathode fluorescent lamp. The hot cathode fluorescent lamp can include a glass tube that has an inner wall which is uniformly coated with a phosphor, glass beads for sealing respective ends of the glass tube, mercury and a rare gas which are sealed within the glass tube, lead wires which are sealed within the respective glass beads and penetrate the respective glass beads, and filaments which are provided at respective ends of the glass tube within the glass tube and which are connected to respective lead wires. The method can include: preparing the glass tube, the inner wall of which is uniformly coated with a phosphor, and two mounts, each of the mounts sealing a pair of the lead wires, ends of the lead wires of one of the mounts each having a bent portion bent outwardly with respect to an axial direction of the glass tube, the other ends of the lead wires supporting and connecting to the filament, the filament being coated with an emissive material; inserting one of the mounts while the filament is directed toward the glass tube till the bent portions of the lead wires abut against an opening end of the glass tube so as to dispose the filament in the vicinity of the one end of the glass tube; forming a vacuum system using an inner space communicating with the glass tube and an exhaust pipe by welding the opening end of the glass tube and an opening end of the exhaust pipe made of a glass material while the bent portions are sandwiched between the opening ends of the glass tube and the exhaust pipe, inserting the other mount while the filament is directed toward the glass tube and disposing the other mount at an appropriate position near the other opening end of the glass tube, and welding the glass tube and the glass bead of the other mount at a predetermined position; activating the emissive material on the filament by evacuating the vacuum system and applying a voltage to the bent portions of the lead wires protruding from the welding portion between the glass tube and the exhaust pipe toward outside of the vacuum system; after activating the emissive material on the filament, supplying mercury and a rare gas into the vacuum system, and sealing the glass tube and the glass bead of the one mount; and removing unnecessary portions of the glass tube, the exhaust pipe and the lead wires.

In an exemplary configuration, the inner diameter of the exhaust pipe can be equal to or greater than the inner diameter of the glass pipe.

In accordance with an aspect of the method for manufacturing a hot cathode fluorescent lamp of the presently disclosed subject matter, the vacuum system can be formed by the inner space of the glass tube and that of the exhaust pipe. One end of the lead wire can be connected to the filament, and the other end thereof can be configured to protrude from the vacuum system toward the outside of the vacuum system. Accordingly, the clamping-connection to the lead wires with the external power source line can be achieved outside the vacuum system so that a voltage can be applied between the ends of the lead wires and the emitter on the filament can be activated by heat generated by energizing the filament.

Accordingly, it is not necessary for the clamp section to have an air discharge function. This can eliminate any complex chucking function for supplying a current.

In manufacturing a conventional hot cathode fluorescent lamp using bead stems, the positioning of the bead stems within the glass tube is sometimes unstable. In some cases, the filament supported by and connected to the lead wires which are sealed in the bead stem may tilt to deteriorate the positional accuracy of the filament, resulting in possible contact with the inner wall of the glass tube.

On the contrary, in accordance with an aspect of the disclosed method for manufacturing a hot cathode fluorescent lamp, the glass tube and the exhaust pipe are integrally welded with the lead wires being sandwiched therebetween. Accordingly, the bead stem sealing the lead wires can be fixed in position within the glass tube by means of the sandwiched lead wires. Consequently, the filament supported by and connected to the lead wires which are sealed in the bead stem can be kept at a predetermined position within the glass tube with high positional accuracy.

This can prevent any contact of the filament coil with the inner wall of glass tube, thereby ensuring or at least making more likely the stable activation of the emitter as well as stable initial luminous intensity. Further to this, the product life characteristics of the hot cathode fluorescent lamp itself as well as the reproducibility of production can be improved.

In accordance with an aspect of the presently disclosed subject matter, the inner diameter of the exhaust pipe may be equal to or greater than the inner diameter of the glass tube. By doing so, it is possible to increase an exhaust rate from the vacuum system, thereby improving the production efficiency.

Furthermore, since the mount in accordance with the presently disclosed subject matter does not necessarily employ flare stems, very thin hot cathode fluorescent lamps with the inner diameter of, for example, 7 mmϕ or smaller can be manufactured.

In accordance with another aspect of the disclosed subject matter, a method for manufacturing a fluorescent lamp can include providing a first tube having a longitudinal axis and a first cross-sectional diameter, a second tube having a second cross-sectional diameter, and a mount structure separate from the second tube, the mount structure including a bead, a filament, and lead wires. The method can include placing the mount structure in a first end portion of the first tube, placing the second tube adjacent the first tube and mount structure to locate the lead wires between the first tube and the second tube, heating the first tube and the second tube to seal the lead wires between at least a portion of the first tube and a portion of the second tube, exhausting the first tube during or subsequent to heating the first tube and the second tube, and sealing the first end portion of the first tube.

BRIEF DESCRIPTION OF THE DRAWINGS

These and other characteristics, features, and advantages of the disclosed subject matter will become clear from the following description with reference to the accompanying drawings, wherein.

DETAILED DESCRIPTION OF EXEMPLARY EMBODIMENTS

A description will now be given of exemplary embodiments in accordance with the presently disclosed subject matter in detail with reference to FIGS. 2 to 5. In the description, the same reference numbers refer to identical or similar sections. The exemplary embodiments described below are specific examples of the presently disclosed subject matter, so the exemplary embodiments have certain technical features and characteristics. The scope of the presently disclosed subject matter is not limited to these exemplary embodiments or their specifically disclosed features and characteristics.

Figure 1:
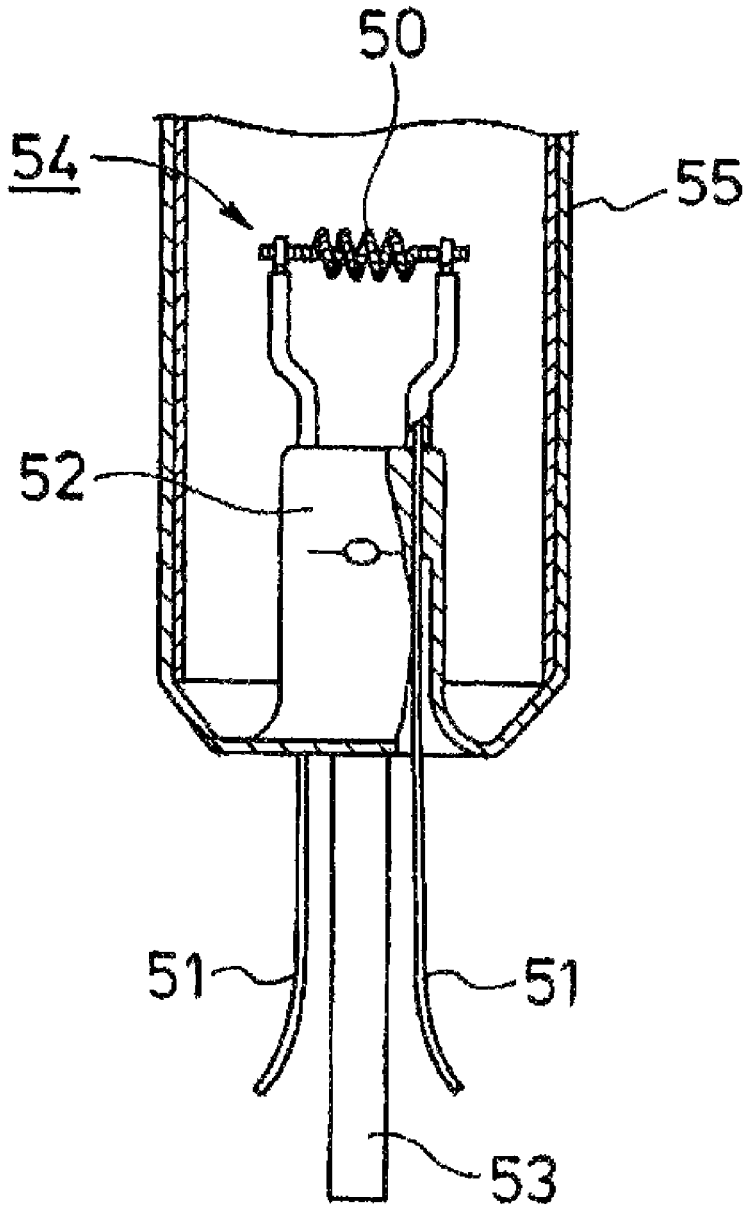
Fig. 1 Conventional Art
FIG. 1 is a cross sectional front view showing the sealing portion of a mount of a conventional hot cathode fluorescent lamp.
Figure 2:
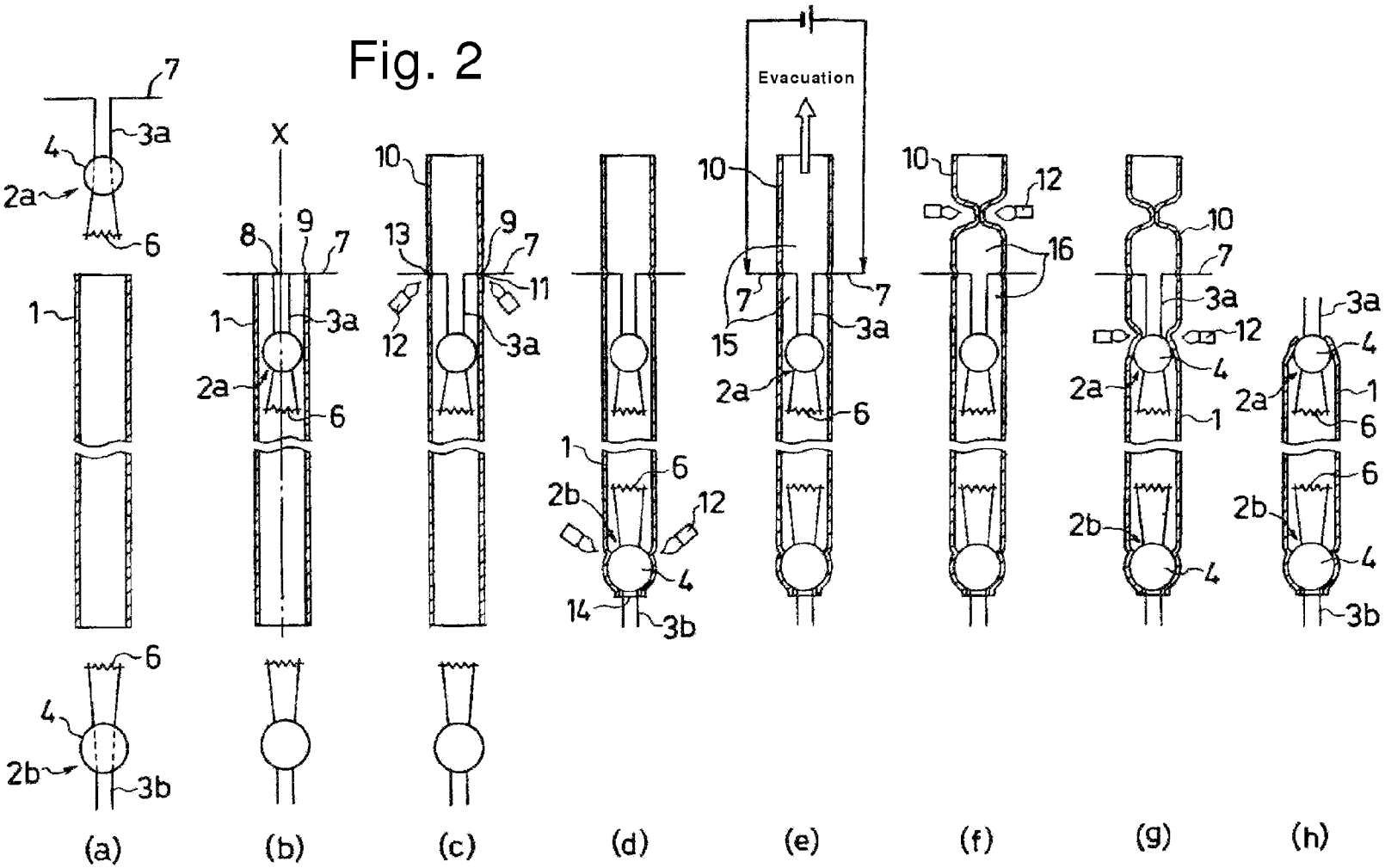
FIGS. 2(*a*)-(*h*) include process diagrams (a) through (h) showing a method for manufacturing a hot cathode fluorescent lamp in accordance with principles of the presently disclosed subject matter.

FIGS. 2(*a*)-(*h*) show a method for manufacturing a hot cathode fluorescent lamp in accordance with the presently disclosed subject matter. Hereinafter, the manufacturing processes will be described in detail.

Figure 3:
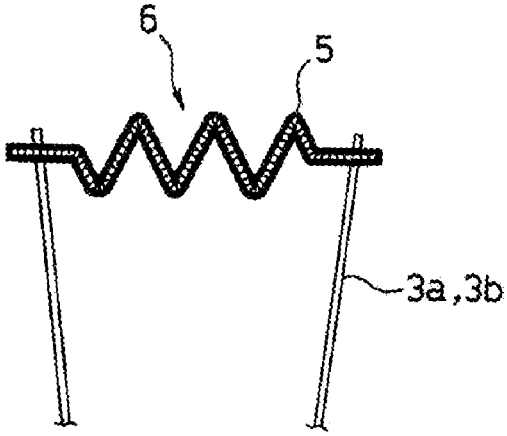
FIG. 3 is an enlarged view of an embodiment of a filament for use in a process in accordance with a method for manufacturing a hot cathode fluorescent lamp in accordance with principles of the presently disclosed subject matter.

In the process shown in FIG. 2(*a*), a glass tube 1 and two mounts 2*a* and 2*b* are prepared. Each mount 2*a* (2*b*) includes a glass bead 4 and a pair of metal lead wires 3*a* (3*b*) sealed within the glass bead 4. As shown in FIG. 3, one ends of the lead wires 3*a* (3*b*) support and connect to a filament 6 at respective ends of the filament 6. The filament 6 is coated with an emissive material (being an emitter for electron emission) which can be in the form of carbonate, etc.

In the mount 2*a*, the other ends of the pair of lead wires (at the opposite end to the filament 6 side) have respective bent portions 7 which are bent outwardly in opposite respective directions. It should be appreciated that the bent portions 7 are not necessary to be bent in exactly opposite respective directions as shown in the drawing. In other words, the bent portions 7 may be bent in any direction as long as a certain insulating distance between the lead wires with respect to the axial direction of the glass tube can be secured (for example, in a normal direction, in a radial direction, or the like).

In the process shown in FIG. 2(*b*), the mount 2*a* is inserted into the glass tube 1 from one opening 8 of the glass tube 1 so that the filament 6 of the mount 2*a* is directed toward the glass tube 1. The filament 6 is inserted into the glass tube 1 until the bent portions 7 abut against the opening end 9 of the glass tube 1. As a result, the mount 2*a* is disposed such that the bent portions 7 protrude from the glass tube 1 in the radial direction with respect to the center axis direction of the glass tube 1.

In the process shown in FIG. 2(*c*), an exhaust pipe 10 that can be made of a glass material is separately prepared. The opening end 9 of the glass tube 1 against which the bent portions 7 of the lead wires 3*a* abut is brought into contact with the other opening end 11 of the exhaust pipe 10 so that the bent portions 7 of the lead wires 3*a* are sandwiched between the opening ends 9 and 11 of the glass tube 1 and the exhaust pipe 10. The contact portion is heated with the use of a gas burner 12 or other means to melt and weld both the opening ends 9 and 11 together to form a welding portion 13.

Accordingly, the bent portions 3*a* are sealed in the welding portion 13 of the opening end 9 of the glass tube 1 and the opening end 11 of the exhaust pipe 10. At the same time, the inner space of the glass tube 1 and the inner space of the exhaust pipe 10 communicate with each other and this state can be kept.

Figure 4:
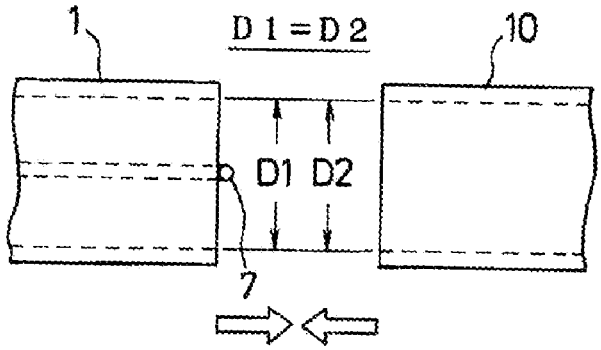
FIG. 4 is a partial plan view showing a size relationship between a glass tube and an exhaust pipe used in a process in accordance with a method for manufacturing a hot cathode fluorescent lamp in accordance with principles of the presently disclosed subject matter.
Figure 5:
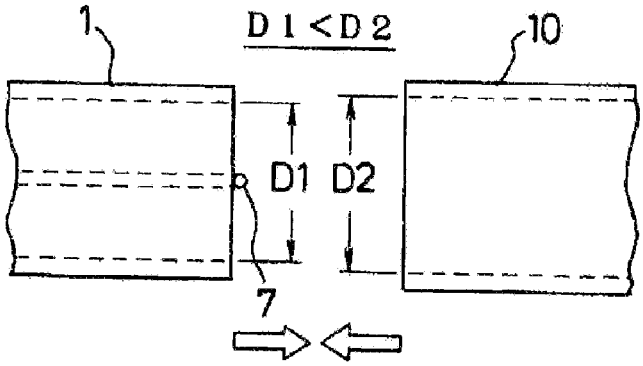
FIG. 5 is partial plan view showing another size relationship between a glass tube and an exhaust pipe used in a process in accordance with a method for manufacturing a hot cathode fluorescent lamp in accordance with principles of the presently disclosed subject matter.

In the presently disclosed subject matter, when the inner diameter of the glass tube 1 is D1 and the inner diameter of the exhaust pipe 10 is D2, the relationship between the inner diameter of the glass tube 1 and the inner diameter of the exhaust pipe 10 may be D1>D2. However, in other modes of the presently disclosed subject matter, it is possible to hold D1=D2 as shown in FIG. 4 or D1<D2 as shown in FIG. 5. Namely, the inner diameter of the exhaust pipe 10 can be equal to or greater than the inner diameter of the glass tube 1 (D1≦D2). By slightly enlarging the inner diameter of the exhaust pipe 10 greater than the glass tube 1, the exhaust efficiency can be improved.

In the process shown in FIG. 2(*d*), the other mount 2*b* positioned near the other end of the glass tube is inserted into the other opening 14 of the glass tube 1 while the filament 6 is directed toward the glass tube. After the mount 2*b* is inserted into a predetermined position, a portion of the glass tube 1 where the glass bead 4 of the mount 2*b* is located nearby is heated with the use of a gas burner 12 or the like to weld the glass tube 1 and the glass bead 4. By doing so, the other end of the glass tube 1 is sealed while the filament 6 and the other ends of the lead wires 3*b* of the mount 2*b* are positioned at the inside of the glass tube 1 and opposite ends of the lead wires 3*b* are located at the outside of the glass tube 1, respectively.

In the process shown in FIG. 2(*e*), the exhaust pipe 10 is connected to a vacuum pump (not shown), and air inside the vacuum system 15 constituted by the inner space of the glass tube 1 and the inner space of the exhaust pipe 10 communicating with each other is exhausted to a state of partial or substantially total vacuum. Then, a power source line extending from an external power source is clamp-connected to the respective bent portions 7 of the lead wires 3*a* of the mount 2*a* to apply a voltage between the bent portions 7. Thereby, the filament 6 is supplied with a current to activate the emitter 5 on the filament 5 by generated heat.

In the process shown in FIG. 2(*f*), mercury (not shown) is supplied into the vacuum system 15 by a mercury dispenser or dropping technique. A rare gas (not shown) can also be supplied. Thereafter, a predetermined portion of the exhaust pipe 10 is heated with the use of a gas burner 12 or other means to heat the portion, thereby chipping or clamping it off. By doing so, a sealed vacuum system 16 having a glass tube 1 sealed at both ends can be formed. In this instance, if mercury is supplied in the form of a mercury dispenser, the system is heated by high frequency heating after chipping or clamping off, to emit mercury vapor within the sealed vacuum system 16.

In the process shown in FIG. 2(*g*), a portion of the glass tube 1 where the glass bead 4 of the mount 2*a* is located nearby is heated by a gas burner 12 or the like to weld the glass tube 1 and the glass bead 4. Consequently, both end portions of the glass tube 1 are sealed between the glass bead 4 of the mount 2*a* and the glass bead 4 of the mount 2*b*, and the mercury and rare gas are sealed inside the sealed space.

In the process shown in FIG. 2(*h*), unnecessary portions of the glass tube 1, the exhaust pipe 10 and the lead wires 3*a* are removed to complete the hot cathode fluorescent lamp in which the respective filaments 6 of the mounts 2*a* and 2*b* are disposed in position within both the end portions of the glass tube 1, respectively. Lead wires 3*a* and 3*b* extend from both of the respective ends of the glass tube 1 to the outside.

Therefore, the complete hot cathode fluorescent lamp is constituted by a glass tube that can have an inner wall which is uniformly coated with a phosphor and which is sealed with the respective glass beads at both ends thereof. Mercury and a rear gas can be sealed within the glass tube. Filaments can be located at respective ends of the inner space of the glass tube, and the lead wires can be connected to the respective filaments through respective glass beads.

As described above, in accordance with a method for manufacturing a hot cathode fluorescent lamp, even if a hot cathode fluorescent lamp with a glass tube of thin diameter (for example, the inner diameter of less than 7 mmϕ) which does not include flare stems is conventionally manufactured, the ends of the lead wires, which support and are connected to the respective filaments at ends thereof, can protrude from the vacuum system to the outside of the vacuum system. The vacuum system can be constituted by the inner space of the glass tube and the inner space of the exhausted pipe communicating with each other. The ends of the lead wires of the mount can be clamp-connected to the power source lines outside the vacuum system and a voltage can be applied thereto, thereby energizing the filaments to activate the emitter on the filaments by generated heat.

Accordingly, it is not necessary for a clamp section to have an air discharge function. This can eliminate complex chucking functions in which a current is supplied.

In manufacturing a conventional hot cathode fluorescent lamp using bead stems, the positioning of the bead stems within the glass tube is unstable. In some cases, the filament supported by and connected to the lead wires which are sealed in the bead stem may tilt, resulting in possible contact with the inner wall of the glass tube.

On the contrary, in accordance with an aspect of a method for manufacturing a hot cathode fluorescent lamp according to the presently disclosed subject matter, the glass tube and the exhaust pipe can be integrally welded with the lead wires sandwiched therebetween. Accordingly, the bead stem sealing the lead wires can be fixed in position within the glass tube by means of the sandwiched lead wires. Consequently, the filament supported by and connected to the lead wires which are sealed in the bead stem can be kept at a predetermined position within the glass tube with high positional accuracy.

The above-described structure can prevent contact of the filament coil to the inner wall of glass tube, thereby ensuring or facilitating stable activation of the emitter as well as stable initial luminous intensity. In addition to this, the product life characteristics of the hot cathode fluorescent lamp itself as well as the reproducibility of production can be improved.

Furthermore, the inner diameter of the exhaust pipe forming the vacuum system may be equal to or greater than the inner diameter of the glass tube. By doing so, it is possible to increase exhaust rate from the vacuum system, thereby improving the production efficiency.

Furthermore, since the above-described mount does not employ a flare stem, and therefore very thin hot cathode fluorescent lamps with the inner diameter of, for example, 7 mmϕ or smaller can be manufactured.

It should be understood that various modifications and changes from the above described embodiments are contemplated and would fall within the scope of the presently disclosed subject matter. For example, the term glass can be considered to refer to any of the known materials used for manufacturing light bulb housing structures, including pure quartz materials, and other silica based and ceramic glasses and mixtures. Glass beads can be formed in various shapes and sizes and still fall within the spirit and scope of the presently disclosed subject matter. Likewise, the shape and size of the glass tube 1 can also be varied to include bent tubes, square cross-section tubes, polygonal cross-section tubes, oval cross-section tubes, non-symmetrical cross-section tubes, etc.

While there has been described what are at present considered to be exemplary embodiments of the presently disclosed subject matter, it will be understood that various modifications may be made thereto, and it is intended that the appended claims cover such modifications as fall within the true spirit and scope of the presently disclosed subject matter.

What is claimed is:

1. A method for manufacturing a hot cathode fluorescent lamp, the hot cathode fluorescent lamp including, a glass tube having an inner wall uniformly coated with a phosphor, mounts including a glass bead for sealing respective ends of the glass tube, mercury and a rare gas sealed within the glass tube, lead wires sealed within and penetrating respective glass beads, and filaments provided at respective ends of the glass tube and connected to respective lead wires, the method comprising:

providing the glass tube, and two mounts, each of the mounts sealing a pair of the lead wires, first ends of the lead wires of a first of the mounts each having a bent portion bent outwardly with respect to an axial direction of the glass tube, other ends of the lead wires of the first of the mounts supporting and connecting to a respective filament, the respective filament being coated with an emissive material;

inserting the first of the mounts while the respective filament is directed toward the glass tube until the bent portions of the lead wires of the first of the mounts abut against an opening end of the glass tube so as to dispose the respective filament adjacent the opening end of the glass tube;

forming a vacuum system using an inner space formed by the glass tube in communication with an exhaust pipe by welding the opening end of the glass tube and an opening end of the exhaust pipe while the bent portions are sandwiched between the opening end of the glass tube and the opening end of the exhaust pipe to form a welding portion, inserting a second of the mounts while a second respective filament is directed toward the glass tube and disposing the second of the mounts at a position adjacent a second opening end of the glass tube, and welding the glass tube and a glass bead of the second of the mounts at a predetermined position;

activating the emissive material on the respective filament by evacuating the vacuum system and applying a voltage between the bent portions of the lead wires of the first of the mounts which protrude from the welding portion between the glass tube and the exhaust pipe and extend outside of the vacuum system;

after activating the emissive material on the filament, supplying mercury and a rare gas into the vacuum system, and sealing the glass tube with a glass bead of the first of the mounts; and removing unnecessary portions of the glass tube, the exhaust pipe and the lead wires of the first of the mounts.

2. The method for manufacturing a hot cathode fluorescent lamp according to claim 1, wherein an inner diameter of the exhaust pipe is equal to or greater than an inner diameter of the glass tube.

3. The method for manufacturing a hot cathode fluorescent lamp according to claim 1, wherein the glass beads are substantially spherical.

4. The method for manufacturing a hot cathode fluorescent lamp according to claim 1, wherein welding includes heating with a burner.

5. A method for manufacturing a fluorescent lamp, comprising:

providing a first tube having a longitudinal axis and a first cross-sectional diameter, a second tube having a second cross-sectional diameter, and a mount structure separate from the second tube, the mount structure including a bead, a filament, and lead wires;

placing the mount structure in a first end portion of the first tube;

placing the second tube adjacent the first tube and mount structure to locate the lead wires between the first tube and the second tube;

heating the first tube and the second tube to seal the lead wires between at least a portion of the first tube and a portion of the second tube;

exhausting the first tube during or subsequent to heating the first tube and the second tube; and sealing the first end portion of the first tube.

6. The method for manufacturing a fluorescent lamp according to claim 5, wherein sealing the first end portion of the first tube includes heating the second tube a second time at a location spaced from the lead wires.

7. The method for manufacturing a fluorescent lamp according to claim 6, wherein sealing the first end portion of the first tube includes heating the first tube at a location adjacent the mount structure such that the first tube and bead fuse together.

8. The method for manufacturing a fluorescent lamp according to claim 5, wherein sealing the first end portion of the first tube includes heating the first tube at a location adjacent the mount structure such that the first tube and bead fuse together.

9. The method for manufacturing a fluorescent lamp according to claim 5, further comprising:

removing at least a portion of the second tube from the first tube.

10. The method for manufacturing a fluorescent lamp according to claim 5, wherein providing includes providing a second mount structure including a second bead, a second filament, and second lead wires.

11. The method for manufacturing a fluorescent lamp according to claim 10, further comprising:

sealing an opposite end portion of the first tube by heating the first tube and the second bead.

12. The method for manufacturing a fluorescent lamp according to claim 5, further comprising:

applying a voltage across the lead wires while exhausting the first tube.

13. The method for manufacturing a fluorescent lamp according to claim 12, further comprising:

supplying at least one of mercury and a rare gas to the first tube during or after applying the voltage across the lead wires.

14. The method for manufacturing a fluorescent lamp according to claim 5, further comprising:

sealing an opposite end portion of the first tube.

15. The method for manufacturing a fluorescent lamp according to claim 5, wherein the fluorescent lamp is a hot cathode fluorescent lamp.

16. The method for manufacturing a fluorescent lamp according to claim 5, wherein locating the lead wires between the first tube and the second tube includes contacting the lead wires with the first tube and the second tube.

17. The method for manufacturing a fluorescent lamp according to claim 5, wherein providing includes providing the first tube wherein the first tube is made of glass and providing the second tube wherein the second tube is made of glass and heating includes melting the glass first tube and the glass second tube about the lead wires.

18. The method for manufacturing a fluorescent lamp according to claim 5, wherein sealing the first end portion of the first tube includes heating the second tube at a location spaced from the bead and fusing the second tube with itself and then heating the first tube at a location adjacent the bead to fuse the first tube and bead together.

19. The method for manufacturing a fluorescent lamp according to claim 5, wherein the first cross-sectional diameter of the first tube is substantially equal to or less than the second cross-sectional diameter of the second tube.

* * * * *